US009263801B2

(12) United States Patent
Lenormand et al.

(10) Patent No.: US 9,263,801 B2
(45) Date of Patent: Feb. 16, 2016

(54) DIRECTIONAL MOBILE ANTENNA WITH POLARIZATION SWITCHING BY DISPLACEMENT OF RADIATING PANELS

(71) Applicant: THALES, Neuilly-sur-Seine (FR)

(72) Inventors: Regis Lenormand, Blagnac (FR); Antonin Hirsch, Toulouse (FR); Patrick Martineau, Toulouse (FR); Jose Ignacio Herranz-Herruzo, Valencia (ES); Alejandro Valero-Nogueria, Valencia (ES); Paul Vincent, Toulouse (FR); Jean-Francois David, Toulouse (FR); Laurence Laborde, Toulouse (FR)

(73) Assignee: Thales (FR)

( * ) Notice: Subject to any disclaimer, the term of this patent is extended or adjusted under 35 U.S.C. 154(b) by 365 days.

(21) Appl. No.: 13/865,029

(22) Filed: Apr. 17, 2013

(65) Prior Publication Data

US 2013/0278474 A1 Oct. 24, 2013

(30) Foreign Application Priority Data

Apr. 20, 2012 (FR) ..... 12 01170

(51) Int. Cl.

| | |
|---|---|
| ***H01Q 19/00*** | (2006.01) |
| ***H01Q 15/24*** | (2006.01) |
| ***H01Q 13/22*** | (2006.01) |
| ***H01Q 21/00*** | (2006.01) |
| ***H01Q 21/24*** | (2006.01) |

(52) U.S. Cl.

CPC ..... *H01Q 15/246* (2013.01); *H01Q 13/22* (2013.01); *H01Q 21/005* (2013.01); *H01Q 21/245* (2013.01)

(58) Field of Classification Search

CPC ... H01Q 15/246; H01Q 13/22; H01Q 21/245; H01Q 21/005

USPC ..... 343/756, 757, 758, 770

See application file for complete search history.

(56) References Cited

U.S. PATENT DOCUMENTS

2001/0019314 A1 9/2001 Quellec et al.

FOREIGN PATENT DOCUMENTS

EP 1107019 A1 6/2001
WO 89/09499 A1 10/1989

OTHER PUBLICATIONS

K.S. Min et al., "Single-Layer Dipole Array for Linear-to-Circular Polarisation Conversion of Slotted Waveguide Array", IEE Proceedings: Microwaves, Antennas and Propagation, Jun. 13, 1996, pp. 211-216, vol. 143, no., IEE, Stevenage, Herts, GB, XP006006567.

Kwant-Seop Son, et al., "Waveguide Slot Array In-Motion Antenna for Receiving Both RHCP and LHCP Using Single Layer Polarizer", Proceedings of Asia-Pacific Microwave Conference, Dec. 1, 2006, pp. 331-334, XP031201493.

*Primary Examiner* — Dieu H Duong

(74) *Attorney, Agent, or Firm* — Baker Hostetler LLP

(57) ABSTRACT

An antenna with polarization switching comprises a support comprising at least two faces each supporting a plurality of waveguides fed with radiofrequency signals and pierced with apertures disposed so as to illuminate radiating elements placed some distance from the said apertures. For at least one given antenna pointing, the said support is able to toggle between at least two different configurations, the said support being configured so as to place, in the second configuration, the second face in a position identical to that taken by the first face in the first configuration, several radiating elements of the first face being, in the said position, oriented differently from radiating elements of the second face. It applies notably to the switching of antennas embedded onboard moving objects on the ground having to operate high-speed communications with a satellite, in particular a geostationary satellite.

11 Claims, 6 Drawing Sheets

DIRECTIONAL MOBILE ANTENNA WITH POLARIZATION SWITCHING BY DISPLACEMENT OF RADIATING PANELS

CROSS-REFERENCE TO RELATED APPLICATION

This application claims priority to foreign French patent application No. FR 1201170, filed on Apr. 20, 2012, the disclosure of which is incorporated by reference in its entirety.

FIELD OF THE INVENTION

The present invention relates to a mobile directional plane antenna able to switch its polarization by displacement of radiating panels. It applies notably to the switching of antennas embedded onboard moving objects on the ground having to operate high-speed communications with a satellite, in particular a geostationary satellite.

BACKGROUND

In order to provide for communications between a fixed point, for example a geostationary satellite, and a moving point, for example a vehicle on the ground, an antenna making it possible to hunt down the fixed point is disposed at the level of the moving object. The constraints to be adhered to by this antenna are severe. Notably, it must be configured so as not to emit in other directions signals with a power density greater than a regulated level, so as not to disturb the service provided for by adjacent satellites. A relatively high precision in the tracking of the satellite must therefore be guaranteed with this type of antenna. By way of example, for coverage of the European continent, the reflector of an antenna on the ground (or on an airborne carrier) must be able to be oriented in relation to an interval of angles lying between about 10° in elevation for Spain and 60° for northern Europe, the reflector being 360° orientable in relation to the azimuth angle. The reflector, with a diameter of about 60 to 70 cm, must thus benefit from a considerable freedom of movement and from a reliable and precise control system, thus leading to bulky and expensive antennas. Moreover, when the polarization of the signals is linear—if for example the satellite comprises an antenna with a single source of signals—, the ground antenna must be constantly aligned with the direction of polarization.

In order to lessen the constraints to be satisfied by ground antennas and thus simplify their production, circular polarization may be employed in place of the aforementioned linear polarization, for example in the Ka band. By way of illustration, the frequency band lying between 19.7 GHz and 20.2 GHz can serve in reception at the satellite level, while the band lying between 29.5 GHz and 30 GHz may be used in emission, coverage being provided for by a set of adjacent spots in right or left circular polarization.

Multibeam satellites cover a territory with a plurality of spots configured in such a way that the signals emitted on two neighbouring spots do not interfere. In addition, the coverage of a satellite comprises spots having various transmission frequencies and/or various polarizations, two neighbouring spots being configured so as not to have, at one and the same time, the same polarization and the same transmission frequency. The frequency characteristics and polarization characteristics of the signals emitted on a spot are generally designated by the expression "spot colour", two neighbouring spots therefore having distinct colours. By way of illustration, with two different polarizations and two different transmission frequencies, four colours of spots may be created.

Antennas onboard mobile craft required to provide for communication with a satellite sometimes cross a boundary between two spots. This is the case, for example, with antennas intended to provide an Internet connection from an aircraft or a train. When the antenna leaves the zone covered by a first spot configured with a first polarization (for example right circular) and enters the zone covered by a second spot configured with a second polarization (left circular), the antenna must switch rapidly so as to modify its emission and/or reception polarization. Furthermore, the radiating elements of a beamforming antenna must be sufficiently close together to avoid the formation of lateral radiation lobes, liable to perturb adjacent communication systems.

A publication by Kwang-Seop Son et al., published in 2006 in "Proceedings of Asia-Pacific Microwave conference" under the title "Waveguide Slot Array In-Motion Antenna for Receiving both RHCP and LHCP using Single Layer Polarizer", discloses an antenna structure comprising sources of signals exciting polarizers aligned on a film. The polarizers are arranged alternately in opposite directions and the sources are separated from the film of polarizers by a radiofrequency-insulating layer provided with a series of cavities placed facing the polarizers in such a way that at a given instant, one polarizer out of two is illuminated by a source. The film may be actuated in translation so that the cavities are placed facing the polarizers which were not previously illuminated. These polarizers being oriented in a different direction from the first polarizers, the polarization of the signals emitted by the antenna is reversed. This antenna therefore makes it possible to carry out a switching between two different polarizations. However, it comprises drawbacks. Indeed, its structure imposes a relatively large distance between the radiating elements, thereby giving rise to overly sizable lateral lobes in the radiation pattern.

The European Patent Application published under the number EP1107019 discloses a radar comprising two antennas mounted back-to-back and fed by different emission sources. The feeding of each antenna is switched as a function of the scanning movement performed. This arrangement allows the radar to increase its scan field. However, the proposed structure is not adapted to the tracking of pointing.

SUMMARY OF THE INVENTION

An aim of the invention is to propose a compact directional antenna, able to switch its polarization and whose manufacturing complexity is moderate. For this purpose, the subject of the invention is a tracking antenna with polarization switching comprising a support comprising at least two faces each supporting a plurality of waveguides fed with radiofrequency signals and pierced with apertures disposed so as to illuminate radiating elements placed some distance from the said apertures, characterized in that for at least one given antenna pointing, the said support is able to toggle between at least two different configurations, the said support being configured so as to place, in the second configuration, the second face in a position identical to that taken by the first face in the first configuration, several radiating elements of the first face being, in the said position, oriented differently from radiating elements of the second face.

The expression tracking antenna is understood to mean an antenna able to maintain its pointing at a given target (for example a satellite), by compensating for the movements of the craft on which it is installed. The antenna according to the invention thus makes it possible to switch its polarization whilst keeping it pointing at the same target.

According to one embodiment of the antenna according to the invention, the support is fixed on a swivel axis suitable for toggling between the two configurations by rotation.

The swivel axis may be configured so that the respective positions of the first and of the second face of the support are mutually substituted after rotation of the support by half a revolution about the said axis.

Advantageously, the swivel axis is parallel to each of the faces.

The swivel axis, termed the first swivel axis, may be mounted on a second swivel axis orthogonal to the said first swivel axis. According to a first embodiment, the first axis makes it possible to orient the antenna in elevation, the second axis making it possible to orient the antenna in azimuth. According to another embodiment, the first axis makes it possible to orient the antenna in azimuth, the second axis making it possible to orient the antenna in elevation.

Advantageously, the radiating elements are dipoles. Moreover, the dipoles of one and the same face may all be oriented in the same direction.

According to one embodiment of the antenna according to the invention, the first face comprises a number of radiating elements equal to the number of radiating elements present on the second face, the radiating elements being disposed on each of the faces so that to each radiating element of the first face there corresponds a radiating element of the second face whose barycentre in the second configuration is identical to the barycentre of the corresponding radiating element of the first face when it is in the first configuration.

According to one embodiment of the antenna according to the invention, the waveguides are guides with rectangular cross-section, the apertures being distributed, for each of the waveguides, on a face of the said waveguide alternately on either side of its longitudinal median axis.

According to one embodiment of the antenna according to the invention, for two adjacent apertures of a waveguide, a radiating element is placed above each of the apertures.

BRIEF DESCRIPTION OF THE DRAWINGS

Other characteristics will become apparent on reading the detailed description which follows by way of nonlimiting example, given in relation to appended drawings which represent.

DETAILED DESCRIPTION

Figure 1A:
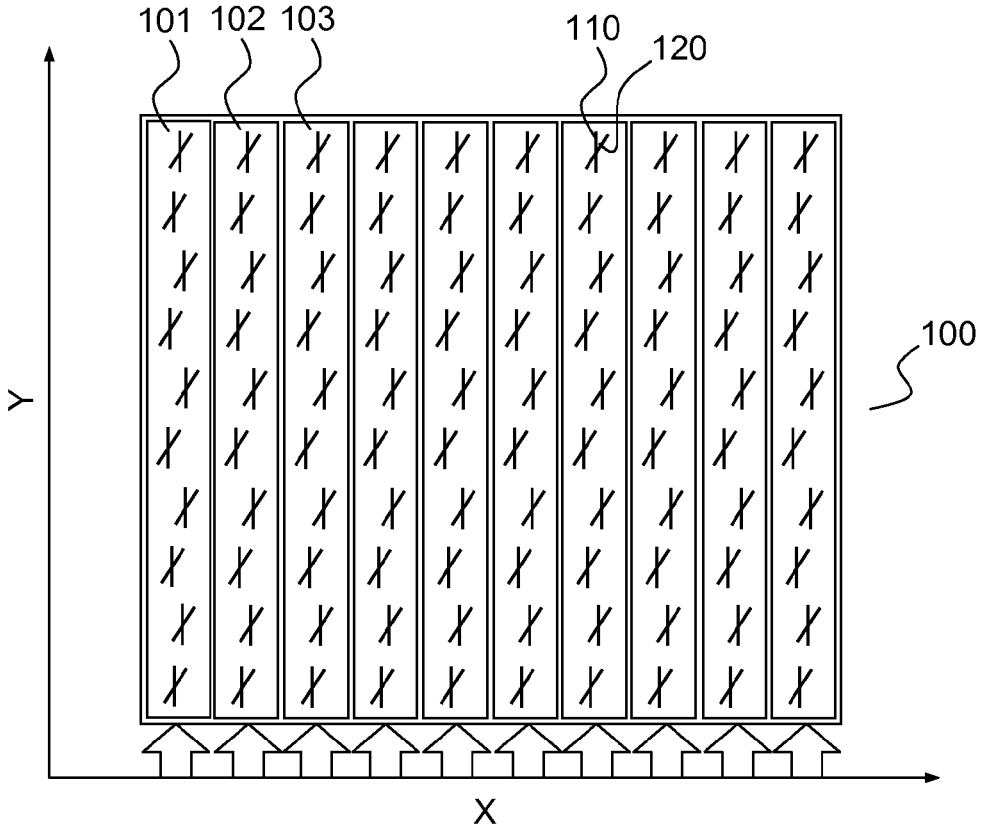
FIGS. 1*a* and 1*b*, basic diagrams illustrating the antenna according to the invention in, respectively, two different configurations.
Figure 1B:
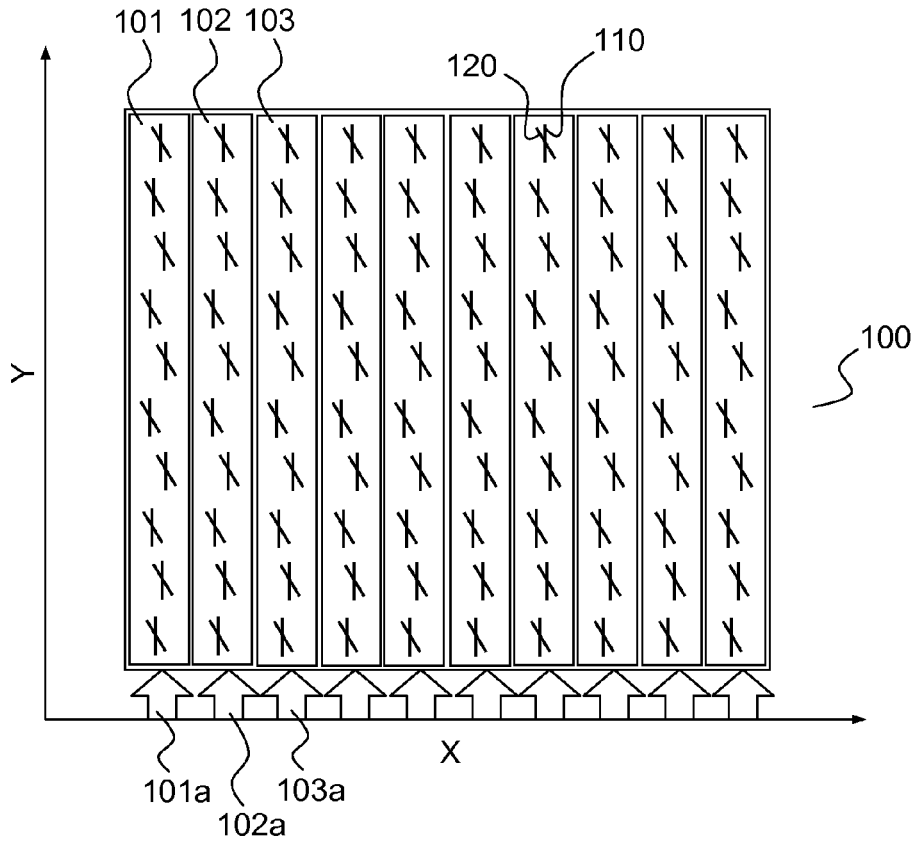

FIGS. 1*a* and 1*b* illustrate by basic diagrams the antenna according to the invention. The antenna 100 is viewed from above. Each of the waveguides 101, 102, 103 is fed with radiofrequency signals 101*a*, 102*a* 103*a* and extends parallel to the Y axis. The waveguides may be guides with rectangular cross-section. Each waveguide 101, 102, 103 is regularly drilled with apertures 110 in the form of rectangular slots preferably parallel to the waveguide. By way of example, the antenna occupies an area of about 6 cm×6 cm.

A radiating element 120 in the form of a dipole is placed above each aperture 110, in a plane parallel to the plane in which the apertures 110 are made. The plane in which the dipoles are placed is advantageously situated at a distance equal to a value chosen between a fifth and a quarter of the wavelength of the signals transmitted in the waveguides, in order to produce such a perturbation on the field coming from the aperture so that two orthogonal field components, equal in magnitude and out of phase by 90 degrees, i.e. a circularly polarized field, are obtained. The choice of the distance causes a phase difference of 90 degrees. The dipoles 120 form, viewed from above, a nonzero and non-perpendicular angle with the apertures 110 formed in the waveguide 101, 102, 103.

The antenna according to the invention can take at least two configurations. FIG. 1*a* illustrates a first configuration of the antenna in which a first angle is formed between each of the apertures 110 and the dipoles 120, this angle being equal, for example, to 45°. That first angle can theoretically take any value between 0° and 90° strictly excluding 0° and 90°. The angle chosen may result from an analysis taking into account lengths and widths of both slot and dipole, along with the selected distance between them and the permittivity of the media around. FIG. 1*b* illustrates a second configuration of the antenna in which the angle formed between the apertures 110 and the dipoles 120 is equal to the opposite of the first angle. Stated otherwise, the dipoles 120 placed above the apertures 110 in the second configuration of the antenna 100 (FIG. 1*b*) form, with the dipoles 120 placed above the apertures 110 in the first configuration (FIG. 1*a*), an angle equal to twice the angle formed between the dipoles 120 of the first configuration and the apertures 110.

Figure 2:
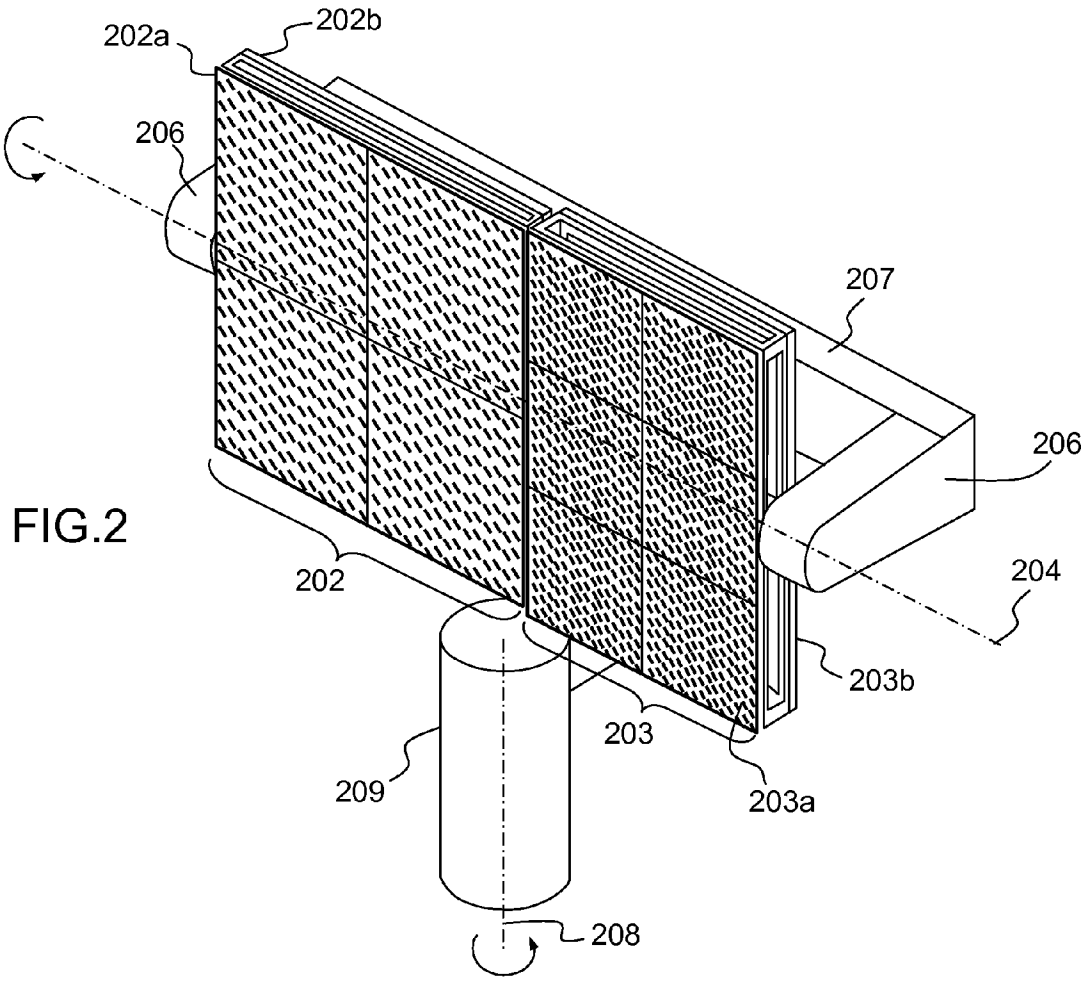
FIG. 2, a view of an embodiment of an antenna according to the invention.

FIG. 2 presents a view of an embodiment of an antenna according to the invention. The antenna 200 comprises two dual-face panels 202, 203, the first panel 202 being intended for the reception of radiofrequency signals, the second panel 203 being intended for the emission of radiofrequency signals. Each panel 202, 203 comprises a first face 202*a*, 203*a* oriented frontwards and a second face 202*b*, 203*b* oriented rearwards.

Each panel 202, 203, is fixed about a first swivel axis 204 making it possible to adjust the orientation of the panels according to the angle of elevation. This first axis 204 is mounted on mobile arms 206 which can move about a second swivel axis 208, by virtue of a vertical pivot 209 making it possible to adjust the orientation of the panels 202, 203 according to the azimuth angle. According to another embodiment, an intermediate third axis is mounted so as to avoid blind zones in the limit of swing of one of the two axes 204, 208 and thus allow the antenna to easily cover the celestial space.

The panels 202, 203 may be rotated on the basis of drive means included in the arms 206, and may be controlled so as to perform at least one complete half-revolution, so as to switch the positions of the two faces 202*a*, 202*b*, 203*a*, 203*b* of each of the panels 202, 203. The arms 206 are thus made sufficiently long to allow the panels 202, 203 to invert their position without hitting the elements 207 effecting the junction between the arms 206 and the pivot 209.

Figure 3:
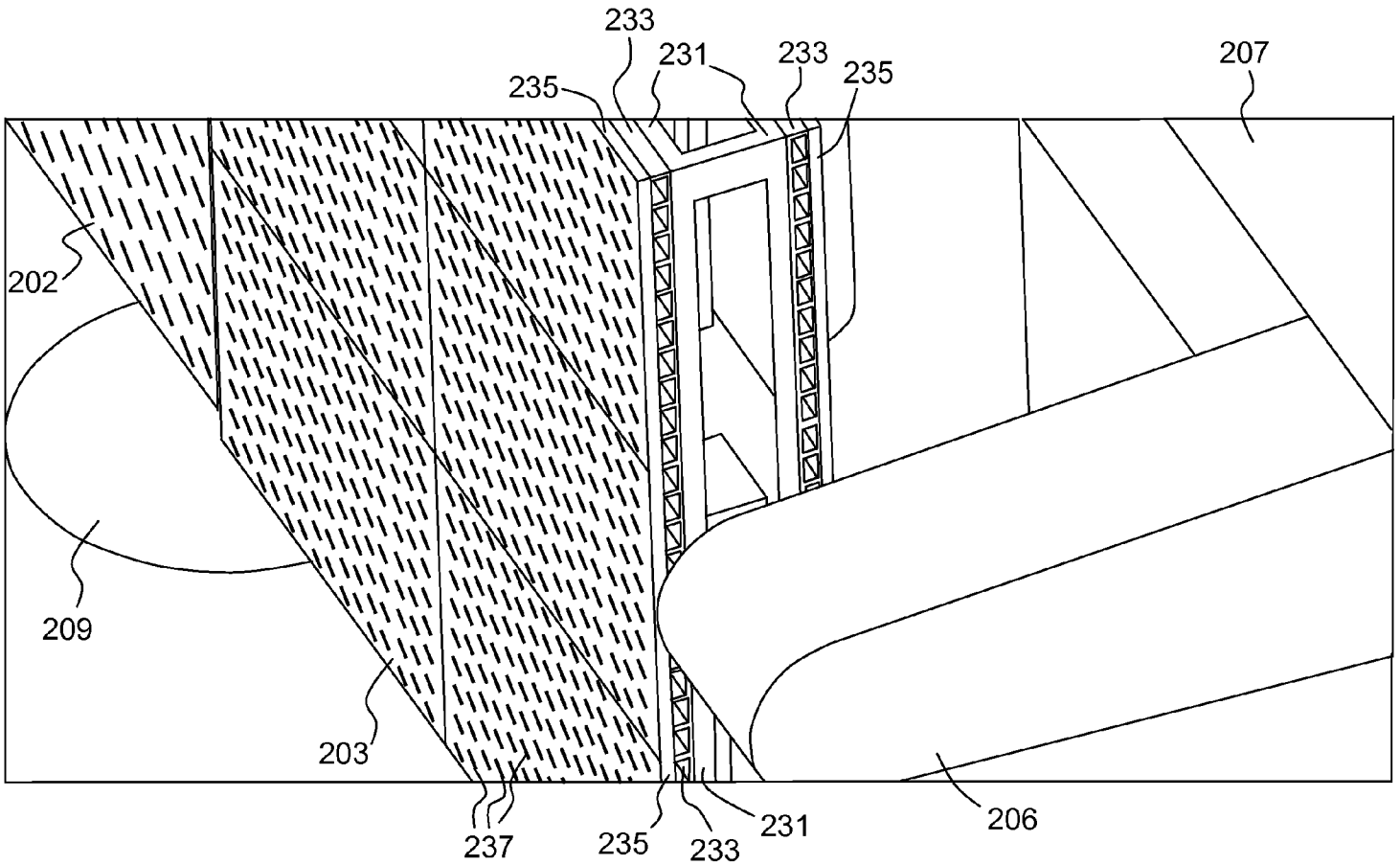
FIG. 3, a magnified view of the supports of waveguides used by an antenna according to the invention.

FIG. 3 presents a magnified view of the supports of waveguides used by an antenna according to the invention. The panel 203 comprises a rigid framework 231, for example of plastic or metallic material, secured to the first swivel axis 204. This framework 231 makes it possible to form a dual-face rotary panel by supporting on each face of the panel, a plurality of waveguides 233 extending in parallel to one another. The waveguides 233 may be fed with a circuit such as that represented and described further on with regard to FIG. 5.

In the example, these waveguides 233 are of rectangular cross-section and are drilled in their upper part (that is to say the face situated away from the rigid framework 231), so as to form slots. Advantageously, the slots are oriented in parallel to one another and in the longitudinal direction of the waveguides 233, as illustrated previously in FIGS. 1*a* and 1*b*. In the example, the slots are placed identically from one waveguide to the other. Moreover, in each waveguide 233, the slots are preferably placed alternately on either side of the longitudinal median axis of the waveguide 133 so that the slots radiate in phase, so as to form a regular grid of slots over the whole surface of a face of the panel 202, 203.

A layer 235 of material transparent to radiofrequency waves is placed above the waveguides 233 so as to support a plurality of dipoles 237. Advantageously, the dipoles 237 are placed facing the slots formed in the waveguides 233, so as to ensure good transmission to the waveguides of a signal received by the antenna or effective radiation by the dipoles 237 of a signal transmitted by these waveguides 233.

Figure 4:
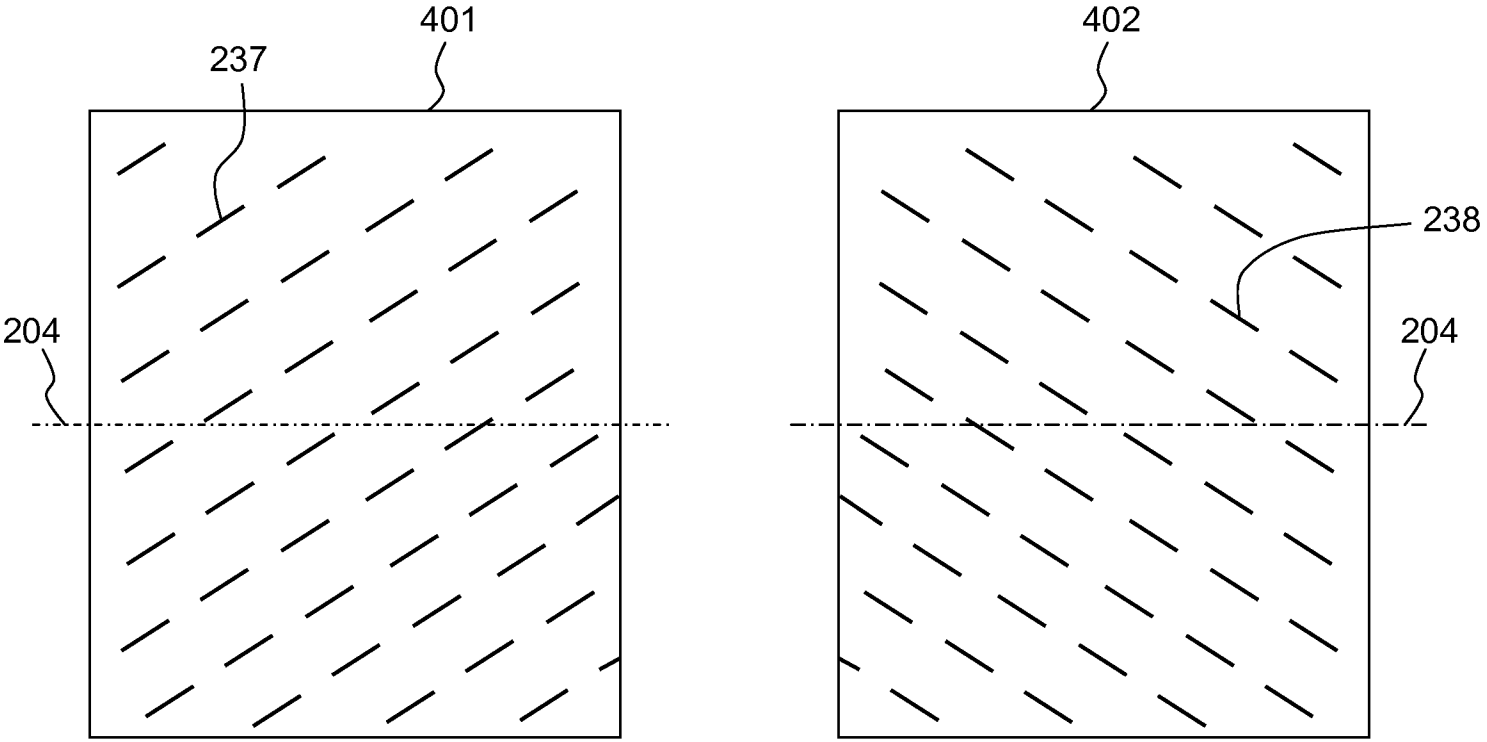
FIG. 4, an illustration of the configurations of dipoles of a multi-face panel of an antenna according to the invention.

FIG. 4 presents an exemplary disposition of dipoles for a panel of an antenna according to the invention. The left plane represents the first face 401 of an antenna panel according to the invention when this first face is turned towards the front of the antenna, and the right plane represents, from the same point of view, the second face 402 of this same panel (opposite side from the first face 401) when this second face 402 is in the same position as the first face, that is to say turned towards the front of the antenna (the first face then being turned towards the rear of the antenna). The dipoles 237 of the first face 401 are oriented in a first direction and the dipoles 238 of the second face 402 are oriented in a different position.

Thus, when the panel is rotated so as to perform half a revolution, the face which was in the inactive position (turned towards the rear of the antenna) replaces the face which was in the active position, stated otherwise, that which was turned towards the front of the antenna. The antenna replaces a radiating face, which was oriented according to a determined elevation angle and a determined azimuth angle, by a radiating face in the same position but having differently oriented dipoles. The polarization of the active face is thus modified by a simple rotation of the antenna panel.

The dipoles may be placed on the faces 401, 402 so that whichever face is in the active configuration, the placements of the centres of gravity of the dipoles on this active face are the same.

According to the configuration of the support arms 206 for the antenna panels, the change-of-polarization rotation is performed about the axis 204 for adjusting the angle of elevation, as shown by FIG. 2. A dipole 237 of one face must generally not, when it undergoes a rotation of half a revolution, lie in a configuration identical to that of the dipole of the opposite face which is in the same placement in the active configuration. This typical case must at least not occur for all the dipoles, in the absence of which the two active configurations of the antenna would be identical and no change of polarization would be possible.

In the example illustrated in FIG. 4, the dipoles of one and the same face are all oriented in the same direction and when the two faces 401, 402 are disposed one behind the other on a rotary panel, the dipoles 237 of the first face 401 are parallel to the dipoles 238 of the second face 402. According to another embodiment of the antenna according to the invention, the dipoles of one and the same face of a panel are not all oriented in the same direction.

The examples presented in this text comprise dual-face panels, but other embodiments comprising supports provided with three, or indeed more faces could be implemented. For example, a support having a structure of triangular prism shape, the first swivel axis 204 of the antenna passing longitudinally at the centre of the prism, makes it possible to place three radiating faces provided with dipoles oriented differently from one face to the other for the two first faces and a dipole-less third face and thus to propose three different configurations of polarization.

Figure 5:
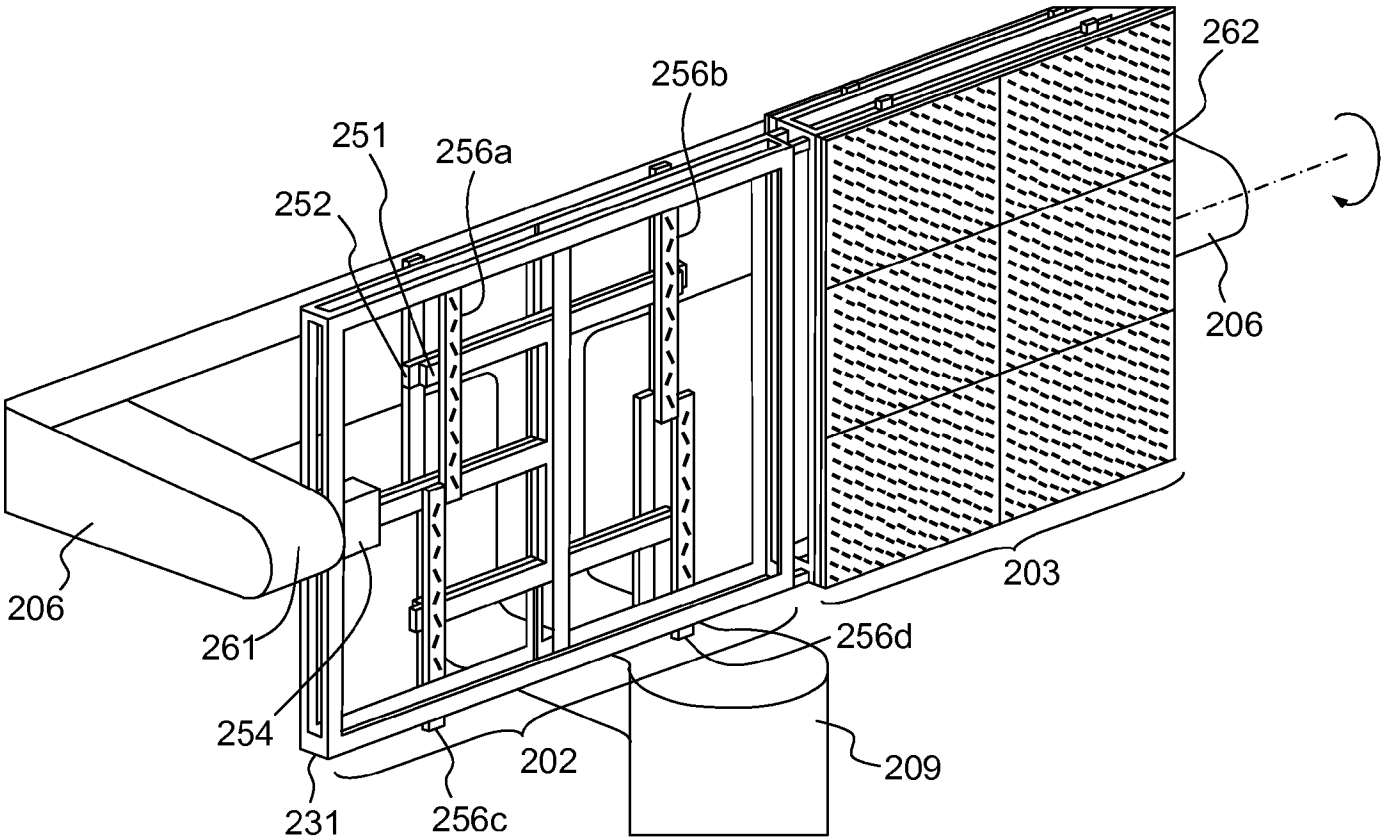
FIG. 5, a representation of the feed circuits for feeding radiofrequency signals to the waveguides of an antenna according to the invention.

FIG. 5 presents a view of the feed circuits for feeding radiofrequency signals to the waveguides. The architecture of the antenna with its rotary panels imposes particular constraints on its production. Indeed, the signals received or emitted by the antenna can pass only through the two junctions 261, 262 between the panels 202, 203 and the arms 206, at the level of the rotation axis 204. The antenna therefore comprises swivel joints at the level of these junctions 261, 262. Waveguides making it possible to transport the signals between the antenna panels 202, 203 and the filters and amplifiers of the radioelectric processing chain (front-end) are passed through these junctions 261, 262. The antenna according to the invention comprises a feed circuit for each face of an antenna panel 202, 203. In the example, the antenna comprises a first feed circuit for the first face 202*a* of the reception antenna panel 202 and a second feed circuit for the second face 202*b* of the reception antenna panel 202. Each feed circuit comprises waveguides 251, 252 fixed at the core of the structure of the panel 202.

The first feed circuit is described, the second being symmetrically identical in the exemplary embodiment. The first feed circuit comprises feed waveguides 251 configured to feed slotted guides 256*a*, 256*b*, 256*c*, 256*d*, which in the example are four slotted guides orthogonal to the radiation waveguides 233 (cf. FIG. 3). The slotted guides 256*a*, 256*b*, 256*c*, 256*d* are disposed so as to feed the set of radiation waveguides 233 by coupling.

To summarize, a face of a panel therefore comprises successively, going from the core of the panel towards the exterior of this panel:

- a swivel joint, a switch 254 and feed waveguides 251;
- slotted guides 256*a*, 256*b*, 256*c*, 256*d* fed by the feed waveguides 251;
- waveguides 233 for radiating on the dipoles 237 or receiving the signals picked up by these same dipoles 237 (cf. FIG. 3);
- a layer of material transparent to radioelectric waves 235 for supporting at a predetermined distance the dipoles 237 above the waveguides 233.

The antenna according to the invention furthermore comprises a switch 254 making it possible to effect the linkup between the waveguides for transmitting the signals to the front-end and the feed waveguides 251, 252 of the panel 202. During polarization switching, the switch 254 fixed for example within the rigid framework 231 makes it possible to select one or the other of the feed circuits 251, 252. Thus, for example, if the first face 202*a* is in the active position and the second face in the inactive position 202*b*, the switch 254 is configured so as to transmit to the front-end the signals picked up on the first face 202*a*. When polarization switching is triggered, the panel 202 is rotated half a revolution, this taking, for example, a second or a few seconds. Concomitantly, the switch 254 connects the front-end circuit of the antenna on the new active face, that is to say the second face 202*b*.

An advantage of the antenna according to the invention is that it does not impose any distance between the slots formed in the waveguides, thereby making it possible to densify the array of radiating elements and thus to obtain a directional radiation pattern. Furthermore, its manufacturing principle is simple and makes it possible to modify the orientation of all the dipoles by way of a common motion (in the example, a rotation of the panel), thereby avoiding discrepancies of adjustment of orientation between the dipoles. It makes it possible to effect cheaper polarization switching, avoiding complex mechanisms effecting distinct switchings by dipoles or groups of dipoles.

The invention claimed is:

1. A tracking antenna with polarization switching, comprising:

a support comprising at least two faces each supporting a plurality of waveguides fed with radiofrequency signals and pierced with apertures disposed so as to illuminate radiating elements placed some distance from the said apertures, wherein, for at least one given antenna pointing, said support is able to toggle between at least two different configurations, said support being configured so as to place, in the second configuration, the second face in a position identical to that taken by the first face in the first configuration, several radiating elements of the first face being, in said position, oriented differently from radiating elements of the second face.

2. The antenna with polarization switching according to claim 1, in which the support is fixed on a swivel axis suitable for toggling between the two configurations by rotation.

3. The antenna with polarization switching according to claim 2, in which the swivel axis is configured so that the respective positions of the first and of the second face of the support are mutually substituted after rotation of the support by half a revolution about the said axis.

4. The antenna with polarization switching according to claim 2, in which the swivel axis is parallel to each of the faces.

5. The antenna with polarization switching according to claim 2, in which the swivel axis, being the first swivel axis, is mounted on a second swivel axis orthogonal to the said first swivel axis.

6. The antenna with polarization switching according to claim 1, in which the radiating elements are dipoles.

7. The antenna with polarization switching according to claim 6, in which the dipoles of one and the same face are all oriented in the same direction.

8. The antenna with polarization switching according to claim 1, in which the first face comprises a number of radiating elements equal to the number of radiating elements present on the second face, the radiating elements being disposed on each of the faces so that to each radiating element of the first face there corresponds a radiating element of the second face whose barycentre in the second configuration is identical to the barycentre of the corresponding radiating element of the first face when it is in the first configuration.

9. The antenna with polarization switching according to claim 1, in which the waveguides are guides with rectangular cross-section, the apertures being distributed, for each of the waveguides, on a face of the said waveguide alternately on either side of its longitudinal median axis.

10. The antenna with polarization switching according to claim 1, in which for two adjacent apertures of a waveguide, a radiating element is placed above each of the apertures.

11. A method of tracking a target using a tracking antenna with polarization switching, the antenna comprising:

a support including at least a first face and a second face that respectively support a plurality of waveguides fed with radiofrequency signals and are pierced with apertures disposed so as to illuminate radiating elements placed a distance from the apertures, wherein, for at least one antenna pointing, the support is configured to toggle between at least a first configuration and a second configuration, the support being configured so as to place, in the second configuration, the second face in a position that the first face is placed in the first configuration, several radiating elements of the first face being, in said position, oriented differently from radiating elements of the second face;

the method comprising:

pointing the first face toward a target, the support being in the first configuration;

tracking the target with the first face while maintaining the support in the first configuration;

toggling the support to be in the second configuration so that the second face takes the place of the first face; and continuing tracking the target with the second face while maintaining the support in the second configuration.

* * * * *